US005924244A

United States Patent [19]

Ohman

[11] Patent Number: 5,924,244

[45] Date of Patent: Jul. 20, 1999

[54] WINDOW HAVING CASING PIVOT-HUNG IN FRAME FOR REVERSIBLE CLOSURE

[76] Inventor: Hans Ohman, Lingongvägen 5 S-426 55, Västra Frölunda, Sweden

[21] Appl. No.: 08/849,293

[22] PCT Filed: Nov. 28, 1995

[86] PCT No.: PCT/SE95/01419

§ 371 Date: May 28, 1997

§ 102(e) Date: May 28, 1997

[87] PCT Pub. No.: WO96/17151

PCT Pub. Date: Jun. 6, 1996

[30] Foreign Application Priority Data

Nov. 28, 1994 [SE] Sweden ..... 9404098

[51] Int. Cl.[6] ..... E05D 15/30

[52] U.S. Cl. ..... 49/252; 49/248; 49/250

[58] Field of Search ..... 49/DIG. 1, 152, 49/153, 154, 155, 156, 157, 158, 159, 160, 213, 214, 246, 247, 248, 250, 251, 252, 253, 501, 504

[56] References Cited

U.S. PATENT DOCUMENTS

| | | | |
|---|---|---|---|
| 1,124,671 | 1/1915 | Soule | 49/252 |
| 1,271,380 | 7/1918 | Soule | 49/248 |
| 2,317,312 | 4/1943 | Swanson et al. | 49/214 |
| 2,585,678 | 2/1952 | Preston | 49/157 |
| 2,648,878 | 8/1953 | Albano | 49/252 |
| 2,718,675 | 6/1955 | Olsen . | |
| 3,052,931 | 9/1962 | Ewing | 49/252 |
| 3,638,360 | 2/1972 | Vaa | 49/248 |
| 3,936,978 | 2/1976 | Barras . | |
| 4,007,558 | 2/1977 | Heggdal . | |
| 4,106,237 | 8/1978 | Bierlich | 49/252 |
| 4,231,207 | 11/1980 | Kern et al. | 49/DIG. 1 |
| 4,275,526 | 6/1981 | Abramson | 49/DIG. 1 |
| 4,815,245 | 3/1989 | Gartner | 49/DIG. 1 |
| 4,850,139 | 7/1989 | Tiesler | 49/213 |
| 5,189,837 | 3/1993 | Ienaga | 49/214 |
| 5,568,703 | 10/1996 | Frank et al. | 49/253 |
| 5,581,941 | 12/1996 | Sill et al. | 49/252 |

FOREIGN PATENT DOCUMENTS 2 013 763 8/1979 United Kingdom .

*Primary Examiner*—Daniel P. Stodola
*Assistant Examiner*—Curtis A. Cohen
*Attorney, Agent, or Firm*—Pillsbury Madison & Sutro LLP

[57] ABSTRACT

A window including a window frame and a casement, the latter being mounted in the frame with the aid of a link-arm mechanism. The casement is pivotable from a closed position within the frame, through 180° to a closed, fully reversed position in the frame. From the latter position, it is pivotable further in the same direction or reversely in the opposite direction.

4 Claims, 4 Drawing Sheets

WINDOW HAVING CASING PIVOT-HUNG IN FRAME FOR REVERSIBLE CLOSURE

This application is the national phase of international application PCT/SE95/01419 filed Nov. 28, 1995 which designated the U.S.

BACKGROUND OF THE INVENTION

The invention concerns an improved window, the casement of which is pivot-hung in its associated frame.

Double glazing as well as triple glazing windows have been developed lately, in which the window panes are treated to prevent strong heat radiation from entering through the glazing. Instead, part of the heat radiation, it reflected back into the atmosphere. In this manner is has become possible to prevent powerful sunlight to heat the premises in a building excessively during the summer, with resulting economy of for instance the energy required to operate an air conditioning system. In many cases it has also become possible to do without Venitian blinds.

However, as summer progresses into autumn and winter, the conditions are the opposite ones. During this period it is desired to prevent heat from the heated premises from radiating through the windows and into the atmosphere.

SUMMARY OF THE INVENTION

The subject invention provides improvements whereby it becomes possible to make use of the advantages brought about by the kind of windows described above all the year around. This possibility is obtained by making the casement pivotable, from a closed position in the window frame, over half a turn to a closed, fully reversed position and, from the latter position, further pivotable in the same direction or pivotable reversely in the opposite direction. In this manner the improvements allow the user a choice of which side of the window he or she wishes to be directed outwards and which to be turned inwards during a certain period.

BRIEF DESCRIPTION OF THE DRAWINGS

The invention should be described in closer detail in the following with reference to the accompanying drawings, wherein.

DETAILED DESCRIPTION

Figure 1:
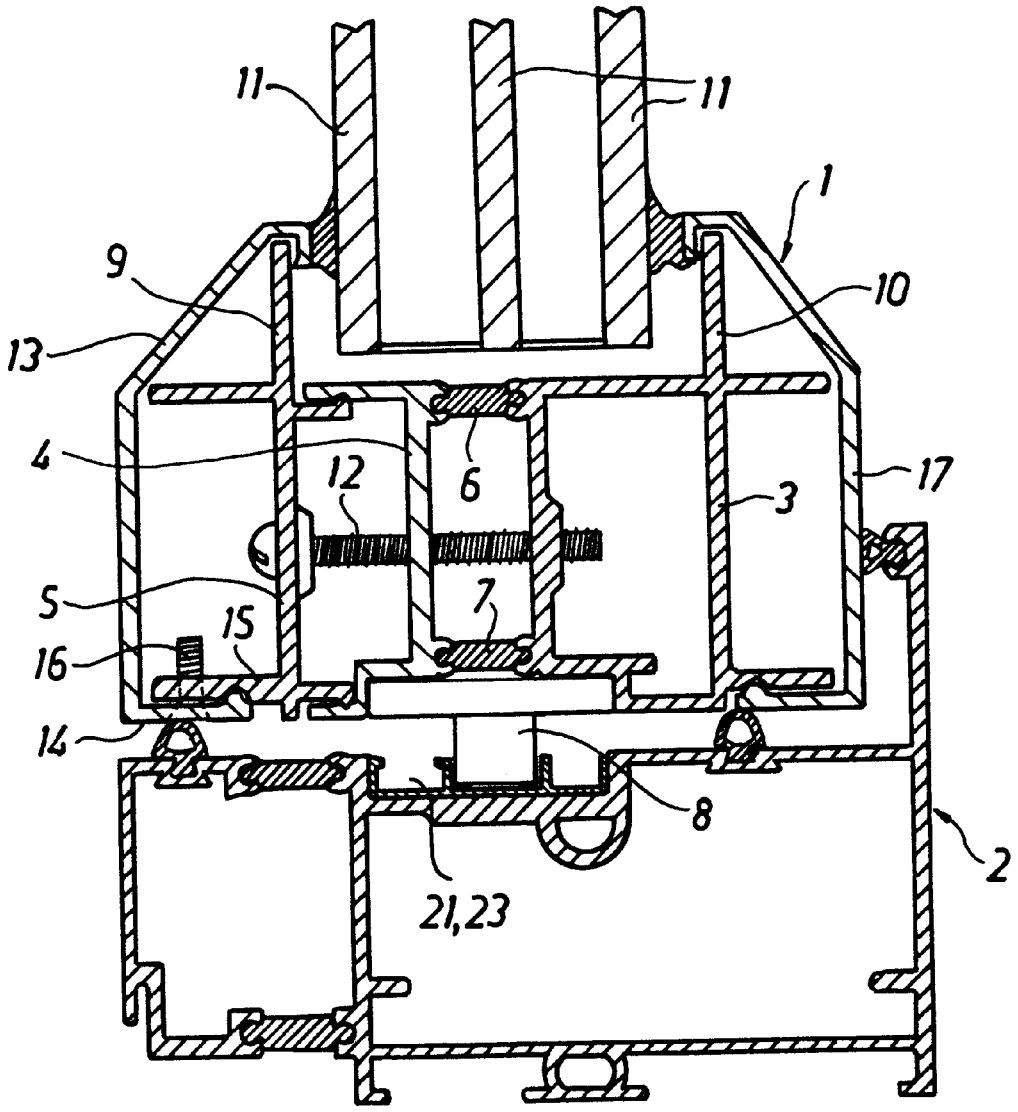
FIG. 1 is a cross-sectional view through a part of the casement and of the frame.

The window to be described in the following consists of a casement 1 which is mounted on pivots in a window frame 2. Each side jamb of the casement 1 intermediate two corner portions consists of two structural profile sections 3, 4, and of a third profile section 5 serving as a glazing strip. The three profile sections 3, 4, 5 extend in mutual parallel relationship. The structural profile sections 3, 4 are interconnected by bridge members 6, 7 having poor heat-conductivity and thus serving to prevent thermal bridges from generating between the external face of the casement 1 to the left in FIG. 1 and its external face to the right in the same drawing figure. A guide bushing 8 is located between the structural profile sections 3 and 4.

The third profile section 5 serving as a glazing strip is formed with a longitudinal edge web 9 which extends past the structural profile section 4 and which together with a corresponding longitudinal edge web 10 on the structural profile section 3 defines a space for reception of an edge portion of the glazing unit 11 which, in accordance with the embodiment illustrated in FIG. 1, consists of three window panes. Screws 12, only one of which is shown in FIG. 1, are equally spaced along said side jamb of the casement 1 in order to secure the profile section 5 to the structure profile sections 3 and 4.

On the screw-insertion face of the casement side jamb, the latter is provided with a covering strip 13 enclosing the longitudinal edge web 9 of profile section 5 in the area adjacent the glazing unit 11. The strip is formed in the area of the opposite longitudinal edge of the profile section 5 with a transverse edge portion 14 which grippingly engages a correspondingly configured transverse edge portion 15 on the profile section 5. The transverse edge portion 14 may be attached to the transverse edge portion 15 by means of screws 16, only one of which is shown in FIG. 1, these screws being directed in such a manner that when the casement 1 occupies its closed position within the frame 2, they are hidden between the casement 1 and the frame 2. Thus, burglarizing attempts by dismounting the casement are made difficult.

The inner face of the casement 1 is fitted with a covering strip 17 of identical configuration to covering strip 13. However, the covering strip 17 need only be snap-fastened to the structural profile section 3, since no screw 12 is accessible from this side.

Figure 2:
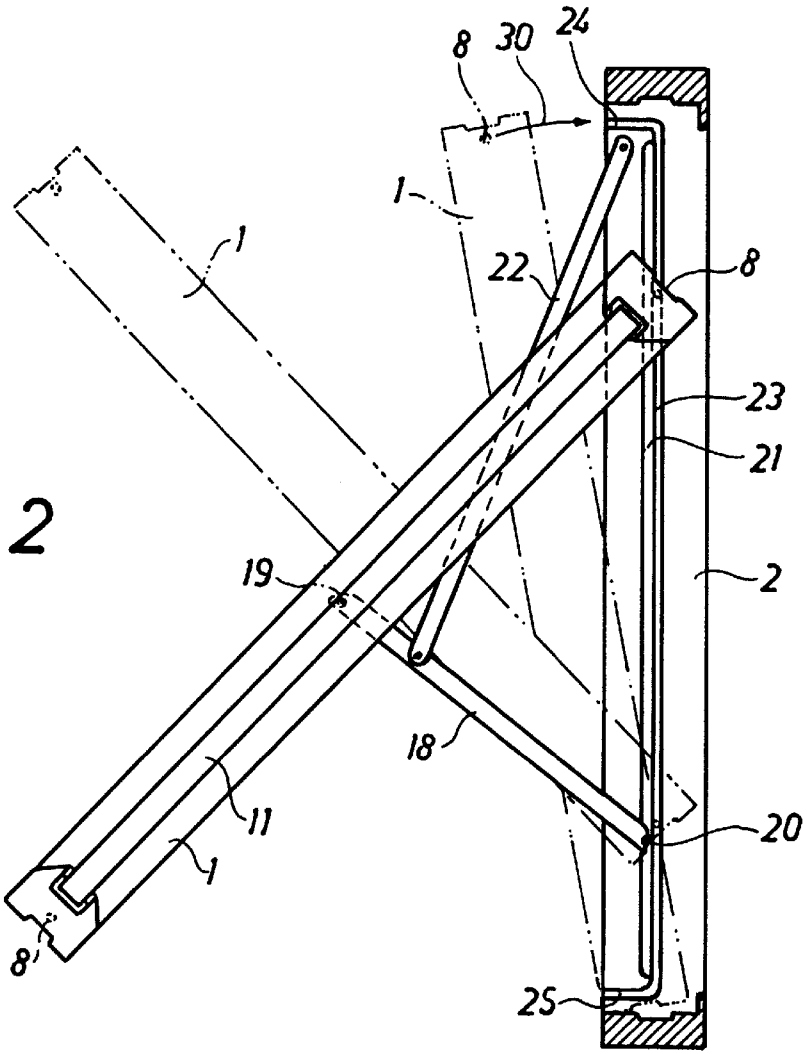
FIG. 2 is a schematical view of the frame and its associated casement, the latter assuming various pivotable positions.

As appears from FIG. 2, the casement 1 is pivotable with respect to the frame 2 with the aid of a pivot mechanism or fitting of a construction known per se. The fitting consists of a link arm 18, one end of which is pivotally mounted on a pivot 19 in the window casement 1, whereas its opposite end is provided with a bushing 20 travelling in a groove 21 formed in the frame. A second link arm 22 has its one end pivotally mounted in the frame 2 and its opposite end articulated to the link arm 18, somewhat interiorly of pivot 19 on the casement. The guide bushing 8 travels in a groove 23 extending in parallel with groove 21 and continuing at its ends into transverse grooves 24 and 25, respectively, opening into the environment.

Figure 3:
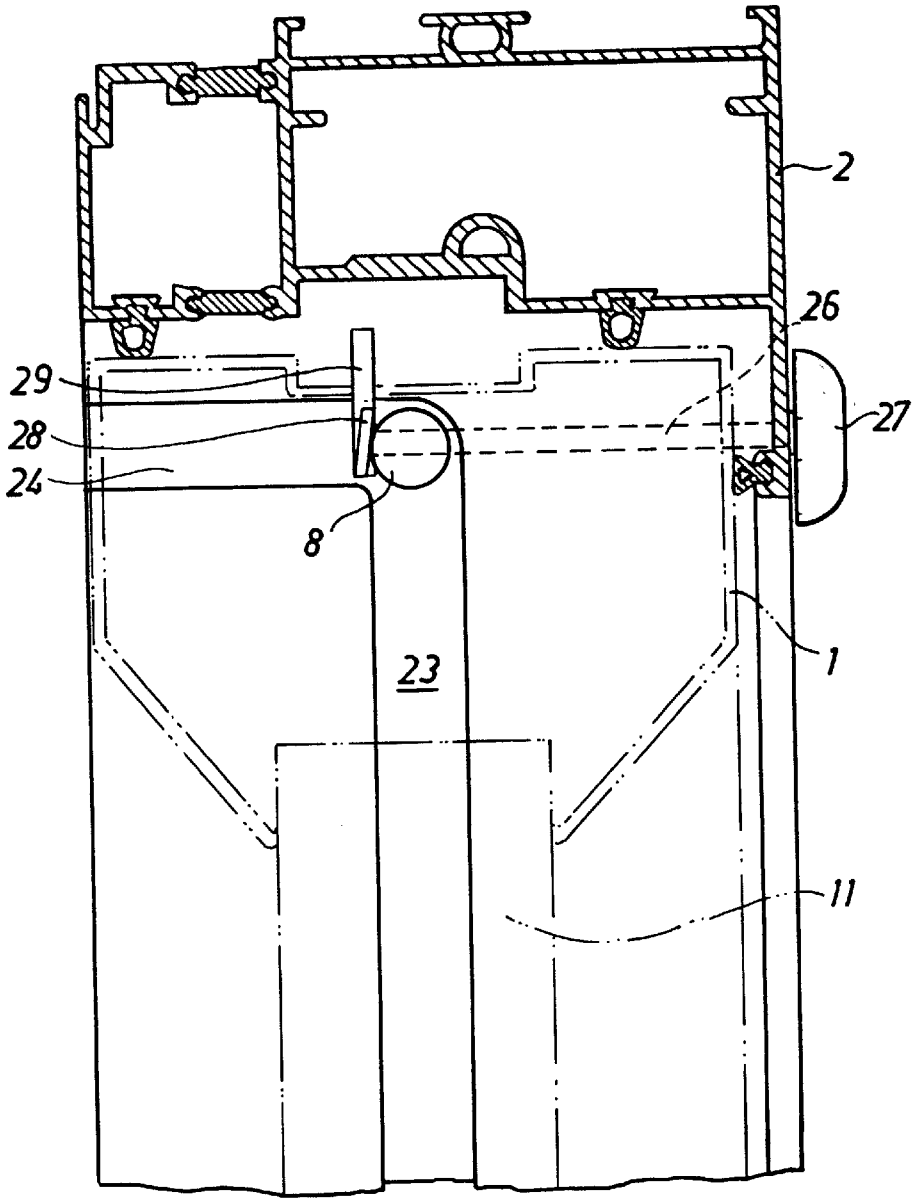
FIG. 3 illustrates on an enlarged scale a cross-sectional view through the frame, including a casement locking means.
Figure 4:
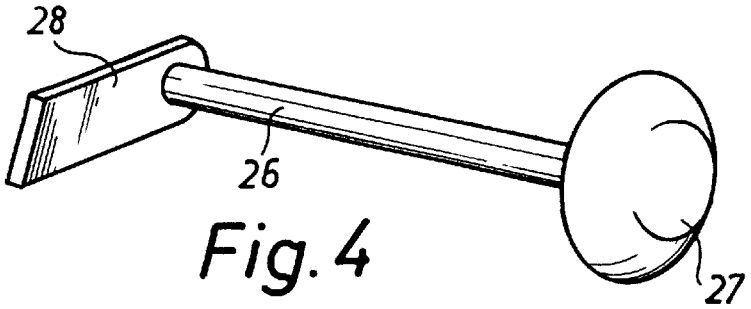
FIG. 4 is a perspective view of said locking means.
Figure 5:
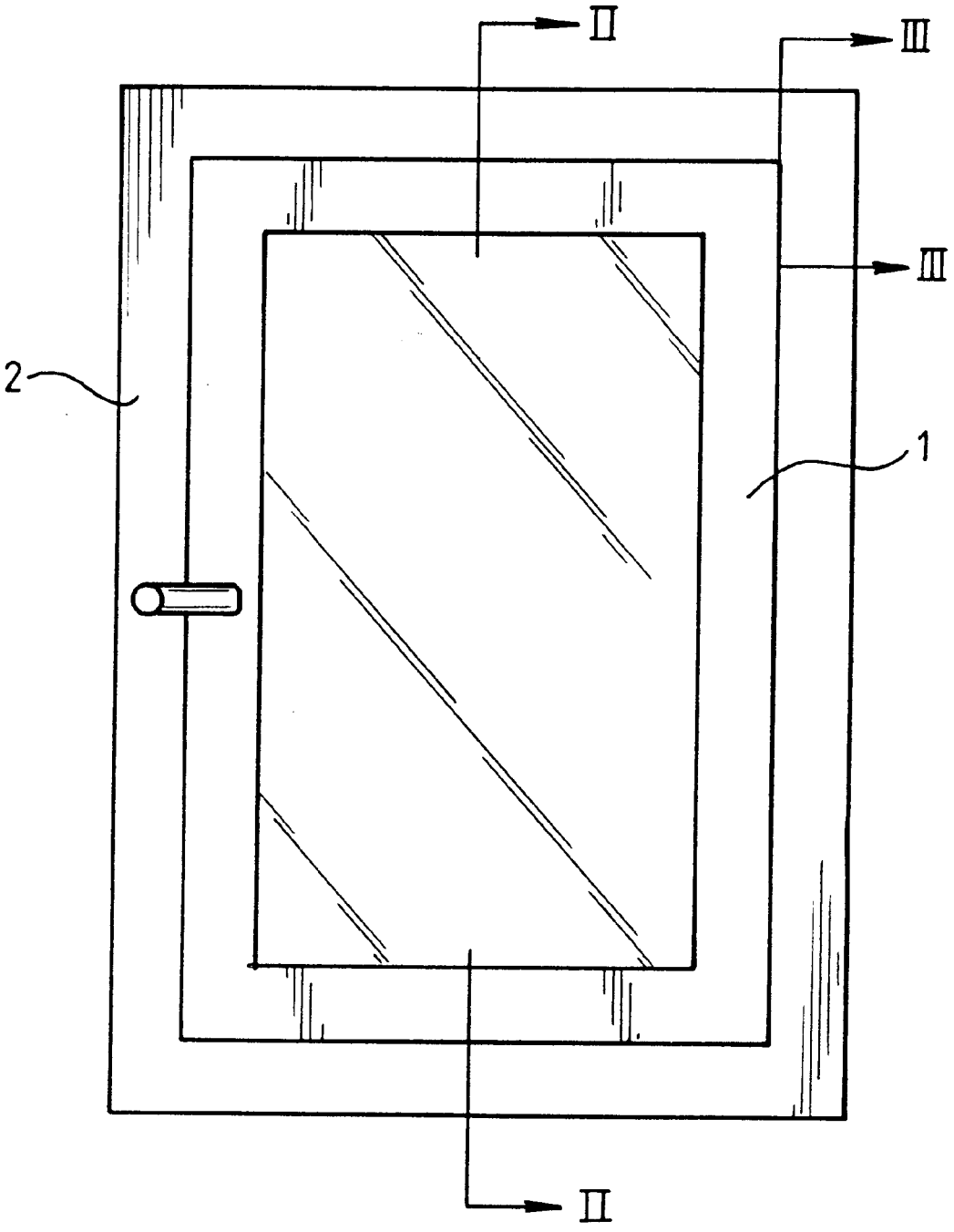
FIG. 5 is an overall view of the casement and frame, showing the cutting planes on which the respective sectional views are taken.

FIGS. 3 and 4 illustrate a locking means in the shape of a turnable member consisting of a turnable shaft 26 supporting a hand wheel 27 at one of its ends and a catch at the opposite one. By turning the hand wheel 27 the catch 28 may be moved from a retracted position inside a slit 29, downwards into a blocking position behind the guide bushing 8.

In accordance with prior-art technology, the casement 1 may be pivoted relatively to the frame 2 in the manner illustrated in FIG. 2 by continuous as well as dash-and-dot lines. In accordance with the invention, the pivotment of the casement 1 may continue in the direction of arrow 30 to position the casement 1 in the frame 2 while the guide bushing 8 is being guided in the transverse groove 24. In this position of reversion over 180°, it is now possible to both lock the casement 1 in the conventional manner by means of a locking fitting (not illustrated) at its one end and also to secure it by means of the turnable means 26, 27, 28 at its opposite end. From this position, it is possible, in accordance with the invention, to pivot the casement 1, following turning of the turnable member to release position, outwardly in the same direction as previously or to pivot the casement backwards in the opposite direction.

Owing to the design of the casement 1 and the frame 2 in accordance with the invention, it thus is without significance which one of the covering strips 13 or 17 that forms the external strip and which one the interior strip. When the window panes 11 are treated in the manner described in the introduction hereto for the purpose of screening off heat radition, the window in accordance with the invention could be utilized optimally, irrespective of season, considering whether or not heat radiation should be screened off from without or within. Owing to the simplicity of manipulation of the window it is easy to make use of the possibility to screen off strong sun light, even if there is a need therefor during a few hours only.

The invention is not limited to the embodiment illustrated and described in the aforegoing but can be varied in several ways within the scope of the appended claims. Obviously, it is possible to arrange for the window to be pivotable either horizontally or vertically.

I claim:

1. A pivotably reversibly closable window, comprising:

a casement having two opposite faces;

a frame having two opposite faces;

two first pivots pivotally mounting said casement along a median thereof, via two respective link-arm mechanisms to said frame for pivoting between conditions wherein said casement is open relative to said frame and whereon said casement is closed, with a selected either one of said two faces of said casement disposed outwards relative to said frame;

said frame having two opposite sides provided with two respective confronting grooves, each having a central longitudinal portion and two opposite transverse portions both of which extend in a same outward direction from the respective central longitudinal portion;

each said link-arm mechanism including a first elongated link pivoted at one end to a respective said first pivot and having a guide bushing provided on an opposite end received in and arranged for traveling along all three said portions of a respective one of said grooves;

each said link-arm mechanism further including a second elongated link pivotably connected at one end thereof by a respective second pivot to a respective said first elongated link intermediate said one and said opposite ends of the respective said first elongated link, and at an opposite end thereof to said frame; and said frame having an external face; each said groove transverse portion opening onto said external face of said frame.

2. The window of claim 1, further comprising:

a shaft mounted in said frame, at an upper location on said frame, for rotation about a longitudinal axis of the shaft;

said shaft having a hand wheel provided on an inner end thereof, which is accessible from an inner face of said window, for manually turning said shaft;

said shaft being provided outwardly ot said hand wheel with a catch which, upon rotation of said hand wheel is movable between a blocking position behind a respective one of said guide bushings so as to prevent pivoting of said casement in a direction required for opening the casement, and a released position wherein pivoting of said casement in said direction is possible.

3. The window of claim 1, wherein;

said casement has two opposite sides corresponding to said two opposite sides of said frame, said two opposite sides of said casement each including an intermediate portion between two corner positions; each said intermediate portion comprising an assembly of:

two structural profile sectors extending in mutual parallel relationship; said two structural profile sections being spaced from one another thicknesswise of the window;

a plurality of bridge elements made of a material having poor thermal conductivity; said bridge elements interconnecting said two transversally spaced structural profile sections, with a respective said guide bushing being thereby secured between said two structural profile sections;

a third structural profile section extending parallel to said two structural profile sections for serving as a glazing strip;

said third structural profile section and one of said two structural profile sections having respective longitudinal edge webs defining therebetween a space arranged to receive a marginal edge portion of a window pane unit: and a plurality of screws securing said third structural profile section to at least one of said two structural profile sections.

4. The window of claim 3, wherein each said intermediate portion further includes:

said screws having heads provided on correspondingly located one ends thereof; thereby providing headed ends;

a covering strip externally covering said third structural profile section, so as to cover said headed ends of said screws;

said covering strip having opposite longitudinal edges thereof disposed in interdigitating relationship with complementary features provided on said third structural profile; and a plurality of screws securing said covering strip to said third structural profile, these screws having heads which are so located as to be physically inaccessible for unscrewing of these screws so long as said casement is disposed in a closed condition relative to said frame.

* * * * *